US006617550B2

(12) United States Patent
Sowa et al.

(10) Patent No.: US 6,617,550 B2
(45) Date of Patent: Sep. 9, 2003

(54) ELECTRICALLY HEATED BLANKET

(76) Inventors: Yoshiji Sowa, 5-go, 7-ban, Shinonome-cho, Izumiotsu-shi, Osaka-fu (JP); Hiroaki Sowa, 5-go, 7-ban, Shinonome-cho, Izumiotsu-shi, Osaka-fu (JP)

( * ) Notice: Subject to any disclaimer, the term of this patent is extended or adjusted under 35 U.S.C. 154(b) by 0 days.

(21) Appl. No.: 10/043,255

(22) Filed: Jan. 14, 2002

(65) Prior Publication Data

US 2003/0132212 A1 Jul. 17, 2003

(51) Int. Cl.[7] ..... H05B 3/36; H05B 3/34; H05B 1/00

(52) U.S. Cl. ..... 219/212; 219/529

(58) Field of Search ..... 219/212, 529; 607/96, 107, 108

(56) References Cited

U.S. PATENT DOCUMENTS 3,028,477 A * 4/1962 Russell ..... 219/212
3,119,926 A * 1/1964 Mills et al. ..... 219/212
3,668,367 A * 6/1972 Williams ..... 219/212
3,739,142 A * 6/1973 Johns ..... 219/212
4,547,658 A * 10/1985 Crowley ..... 219/212
4,792,663 A * 12/1988 Kishimoto et al. ..... 219/212
5,081,341 A * 1/1992 Rowe ..... 219/212
5,405,371 A * 4/1995 Augustine et al. ..... 607/107
5,811,765 A * 9/1998 Nakagawa et al. ..... 219/212
6,300,597 B1 * 10/2001 Lee ..... 219/212

* cited by examiner

*Primary Examiner*—Joseph Pelham
(74) *Attorney, Agent, or Firm*—Ronald E. Greigg

(57) ABSTRACT

An electrically heated blanket which is able to adjust temperature by means of a controller comprising a main blanket body composing of fabrics, two heater cables arranged over the main blanket body which form a configuration of a concave or a U-letter in a plan view. The two heater cables are arranged adjacent and in parallel to each other, beginning ends thereof being connected to the controller and the terminal ends thereof being connected to each other in which electric current flows in opposite directions.

6 Claims, 4 Drawing Sheets

ELECTRICALLY HEATED BLANKET

BACKGROUND OF THE INVENTION

This invention relates to an electrically heated blanket, and more particularly, to a blanket to warm a human body by heating the blanket by electrifying a heater wire laid in the blanket.

The blanket referred to in this invention means every kind of blankets to warm human body including a blanket used as a bedcover, a blanket which directly covers a human body, a blanket which is spread over a bed or a mat on which a human body is laid, and so forth, irrespective of a fabric composing the blanket.

In the past, a bad effect of a magnetic field and an electric field on human body was a problem in this kind of blankets. To solve the problem, a couple of means are suggested.

One of the means is to de-energize magnetism by making synthetic resin of insulating material, which covers the heater wire, contain a special material, and the other means is to de-energize magnetism by offsetting magnetism by laying two heater cables adjacently and in parallel to each other in each of which heater wire electricity flows in opposite directions.

It was proved recently that the latter means works more effectively to de-energize magnetism in comparison to the former.

The bad effect of magnetism almost became able to be avoided due to the above-mentioned means for solution, however, as the heater wire is conventionally arranged all over the blanket, an effect of remaining magnet on the head of human being is worried about.

In addition, the heater wire is so constructed that temperature can be controlled by an equipped controller. The heater wire is laid all over the blanket.

However, a trunk of a human body has comparatively high temperature by nature. Therefore, when the heater wire is heated, the temperature of a portion of a blanket, which covers a chest of the body, rises sooner than a portion of the blanket, which covers feet. Consequently, heating of the chest caused perspiration and the temperature of the head rose because of circulation of heated blood to the head, which presented a problem of sleep disturbance.

SUMMARY OF THE INVENTION

An object of the present invention is to lessen an effect of magnetism on a human head and to control rise of temperature of a portion of a blanket covering near a human chest.

In order to achieve the above-mentioned object, the electrically heated blanket according to this invention is structured to be able to control temperature by a controller. The electrically heated blanket comprises a main blanket body, and two heater cables arranged over the main blanket body to form a space of a concave or a U-letter configuration in a plan view, said two heater cables being arranged adjacent in parallel to each other and their beginning ends being connected to the controller and their terminal ends being connected to each other so as to flow electric current therein in opposite directions.

In the present invention, each of the two heater cables preferably comprises a first heater wire which is wound helically around a core thread, a second heater wire which is wound concentrically with, around periphery of and in the same direction with the first heater wire via an insulating layer, a sensor wire which is wound concentrically with and around periphery of the second heater wire via an insulating layer, and an insulating layer covering the sensor wire.

Further, in the present invention, when the main blanket body is of large size, the two heater cables are preferably arranged so that the if heater cables form another space of a concave or a U-letter configuration in a plan view in continuous with the first space at the upper portion of the main blanket body.

Further, the fabric composing the main blanket body is preferably undergone antibacterial treatment.

According to this invention, the two heater cables are arranged over the main blanket body so that the heater cables form a space of a concave or a U-letter configuration in a plan view at the upper portion of the main blanket body. Because of the arrangement, magnetism can be de-energized (99%) by the electric current flowing in opposite directions, and heating vis-a-vis the chest, having a high temperature by nature, can be controlled, by which uncomfortableness caused by heating of the chest and the head can be eliminated and the effect of the remaining magnetism (about 1%) on the chest and the head can be avoided in advance.

Thus, over-perspiration can be controlled and comfortable sleep can be obtained.

Furthermore, by making the two heater cables wind concentrically with each other, the heater cables can be positioned adjacently to each other and the effect of de-energizing of magnetism can be intensified. In addition, by arranging the sensor wire on the very surface, which means there exists two insulating layers in total, leak of remaining magnetism can be prevented more surely. At the same time, by arranging the sensor wire on the very surface, it becomes easier to sensor the temperature of the main blanket body, and control of the temperature can be done accurately.

Still further, according to this invention, in a main blanket body of a larger size like a queen size or a king size, said effect of de-energizing of magnetism and the control on heating the chest can be obtained for two human bodies at the same time by arranging the two heater cables so that the heater cables form another space of concave or U-letter configuration in a plan view in continuous with the first space at the upper portion of the main blanket body.

The other advantages of this invention will be fully understood from the following description on embodiments on reference to the drawings.

BRIEF DESCRIPTION OF THE DRAWINGS

The drawings show the preferred embodiments of the electrically heated blanket according to the present invention, in which.

DETAILED DESCRIPTION OF THE PREFERRED EMBODIMENTS

Figure 1:
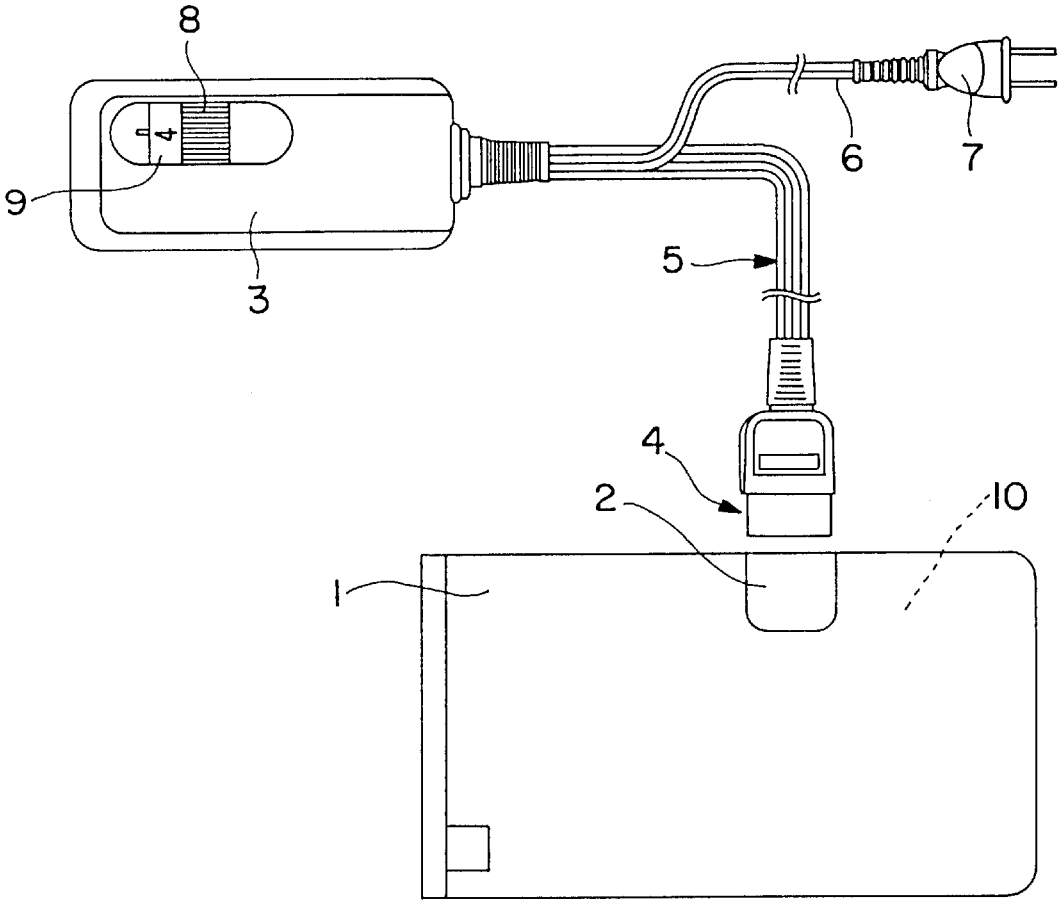
FIG. 1 shows a schematic plan view of the whole electrically heated blanket.

In FIG. 1, 1 shows a main blanket body to be spread over a human body comprising a face fabric and a lining fabric combined together, which are made of synthetic fiber and are undergone antibacterial treatment. Needless to say, the main blanket body 1 may be fabric of natural fiber or a mixed-spun of natural fiber and synthetic fiber. In the present embodiment, the fabric is a mixed fabric of 50% polyester and 50% acryl and is undergone antibacterial treatment.

The numeral 2 shows a connecting plug provided at upper portion of the main blanket body 1, namely, at the portion where a head of a human is supposed to be placed. A connecter 4 of a controller 3 is plugged into the connecting plug 2. One end of a blanket-side cord 5 is connected to the connector 4, and the other end of the same is connected to the controller 3.

A power-source cord 6 is extended from the controller 3, and is provided with a power source plug 7 at the end thereof. Further, the controller 3 is provided with a temperature control dial 8 which is also used as an on/off switch and has a dial graduation 9 indicating the temperature control. As the electric circuit and the like including the temperature control function of the controller 3 belongs to a conventional art, details thereof are not described here.

In the meantime, the voltage is 100 V and the wattage is 55W in this embodiment, while those may be adjusted according to where the electrically heated blanket is used.

Figure 2:
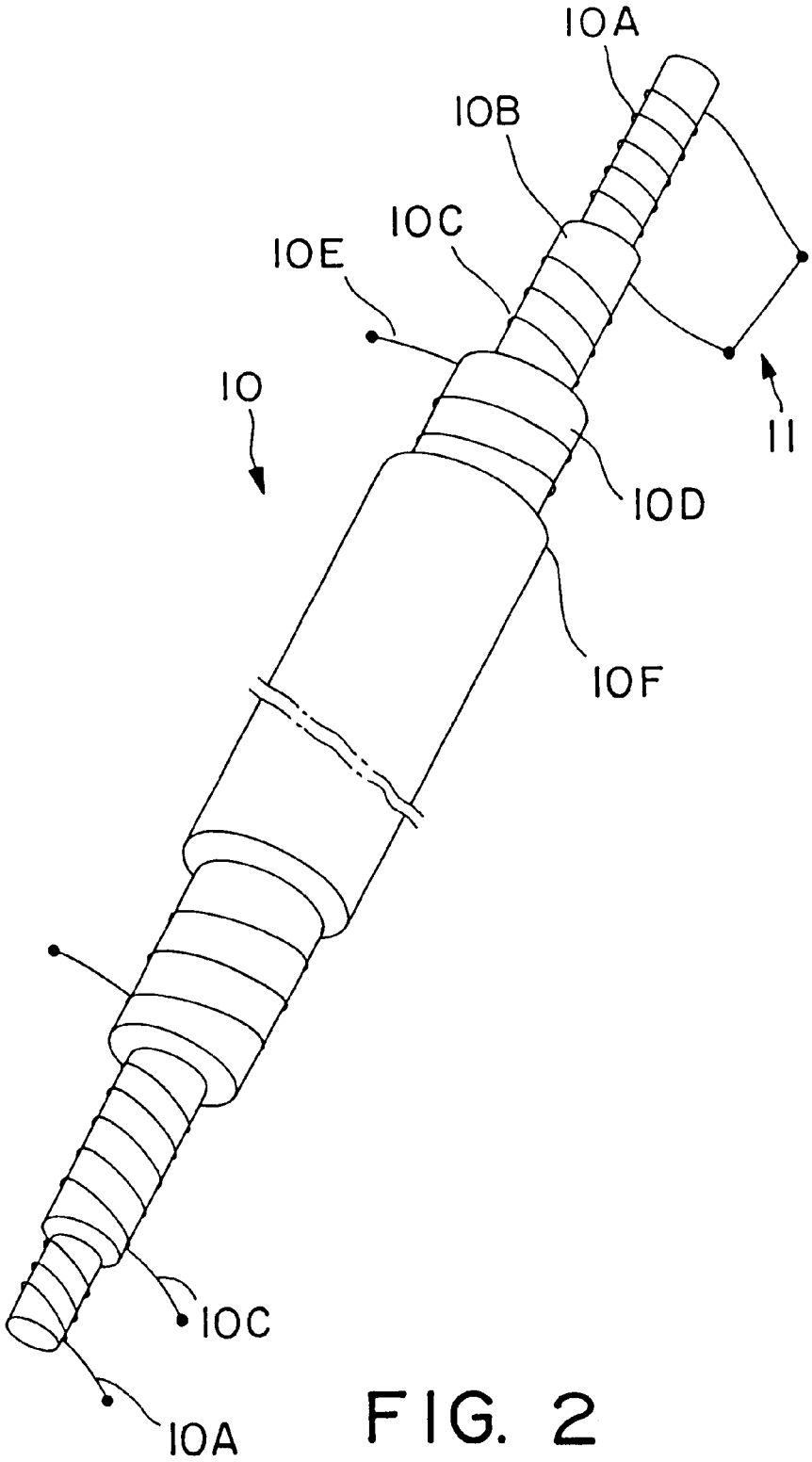
FIG. 2 shows a schematic view of heater cables.

Two heater cables 10 are laid and attached within the main blanket body 1. The heater cables 10 are constructed as indicated in FIG. 2.

Namely, each of the heater cables 10 includes a first heater wire 10A which is wound helically around a core thread, upon periphery of which there is an insulating layer 10B, via which a second heater wire 10C is wound concentrically with, around periphery of, and in the same direction with the first heater wire 10A, upon which there is an insulating layer 10D, via which there is a sensor wire 10E wound concentrically with and around the second heater wire 10C, over which there is an insulating layer 10F covering the sensor wire 10E.

Further, beginning ends of the first heater wire 10A and the second heater wire 10C are connected to the connecting plug 2, and the terminal ends thereof are connected to each other by a connection 11. Consequently, electric current in the first heater wire 10A and the second heater wire 10C flows in opposite directions, by which magnetic field generated at each of the heater wires are offset against each other.

Figure 3:
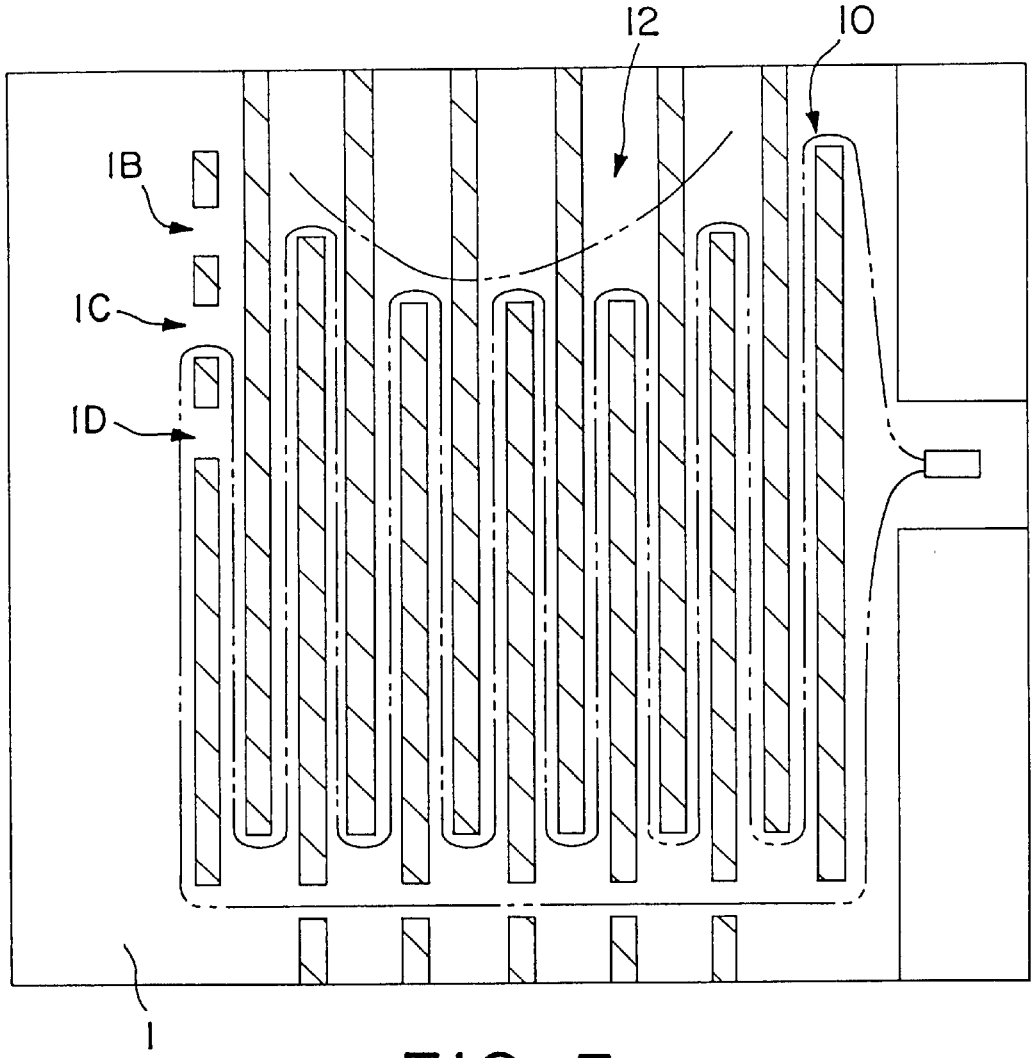
FIG. 3 shows a plan view of an arrangement of heater cables of a main body of the blanket disassembled.

As shown in FIG. 3 showing a state in which one of the outer fabrics of the main blanket body 1 is de-energized, the heater cables 10 are arranged on the main blanket body so that the same form a space of a concave or a U-letter configuration in a plan view at the upper portion of the main blanket body where the human head is placed. In FIG. 3, 1A indicates a hutching in which the heater cables 10 are arranged, and 1B, 1C and 1D indicate bypasses to adjust the length of the heater cables 10 when being arranged. 1E indicates a position where the connecting plug 2 is installed.

Figure 4:
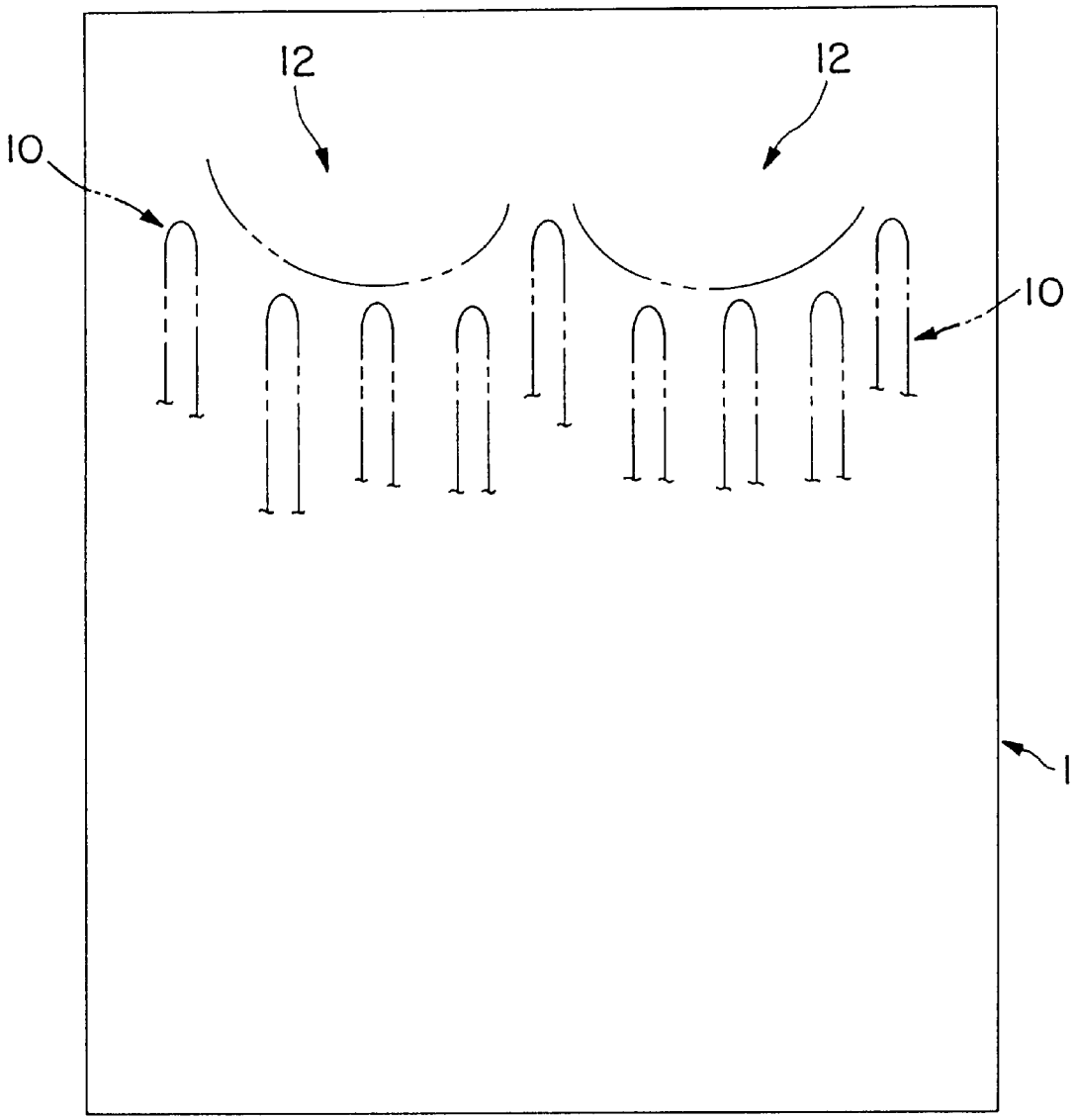
FIG. 4 shows a plan view of an arrangement of heater cables of a main body of a large-sized blanket disassembled.

FIG. 4 shows the main blanket body 1 in large-size being king-size, for example, in which the heater cables 10 form space 12 in a concave or a U-letter configuration in a plan view at the upper portion of the main blanket body where the head of human is placed.

Due to the existence of the two portions of space 12, heating vis-a-vis chests of two bodies can be controlled and the effect of remaining magnetism can be prevented.

The configuration of the space 12 according to this invention may not necessarily be a clear concave or a U-letter. Namely, it is enough that the heater cables 10 are kept away from the upper portion of the blanket body 1 where a chest or a head is supposed to be placed, and are not arranged evenly all over the main blanket body 1

We claim:

1. An electrically heated blanket structured to be able to control temperature by a controller, comprising;

a main blanket body, and two heater cables arranged over the main blanket body to form a space of a concave or a U-letter configuration in a plan view, said two heater cables being arranged adjacent in parallel to each other and their beginning ends being connected to the controller and their terminal ends being connected to each other so as to flow electric current therein in opposite directions.

2. The electrically heated blanket as claimed in claim 1, wherein each of the two heater cables comprises a first heater wire which is wound helically around a core thread, a second heater wire which is wound concentrically with and around a periphery of the first heater cable in the same direction with the first heater wire via an insulating layer, a sensor wire which is wound concentrically with and around a periphery of the second heater wire via an insulating layer, and an insulating layer covering the sensor wire.

3. The electrically heated blanket as claimed in claim 1, wherein when the main blanket body is of large size, the two heater cables are so arranged that the heater cables form another space of a concave or a U-letter configuration in a plan view in continuous with the first space at the upper portion of the main blanket body.

4. The electrically heated blanket as claimed in claim 2, wherein when the main blanket body is of large size, the two heater cables are so arranged that the heater cables form another space of a concave or a U-letter configuration in a plan view in continuous with the first space at the upper portion of the main blanket body.

5. The electrically heated blanket as claimed in claim 3, wherein a fabric of the main blanket body is undergone antibacterial treatment.

6. The electrically heated blanket as claimed in claim 4, wherein fabrics of the main blanket body is undergone antibacterial treatment.

* * * * *